United States Patent [19]

Kurando

[11] Patent Number: 4,819,022

[45] Date of Patent: Apr. 4, 1989

[54] AUTOMATIC EXPOSURE DEVICE FOR COPYING MACHINE

[75] Inventor: Shigeo Kurando, Osaka, Japan

[73] Assignee: Mita Industrial Co., Ltd., Osaka, Japan

[21] Appl. No.: 22,162

[22] Filed: Mar. 5, 1987

[30] Foreign Application Priority Data

Mar. 11, 1986 [JP] Japan ..... 61-53074

[51] Int. Cl.[4] ..... G03G 15/00; G03G 15/20

[52] U.S. Cl. ..... 355/14 FU; 355/3 FV; 355/14 C; 355/14 R

[58] Field of Search ..... 355/3 F, 14 FU, 14 E, 355/67, 69, 68, 14 R, 14 C, 8

[56] References Cited

U.S. PATENT DOCUMENTS

| | | | |
|---|---|---|---|
| 3,947,117 | 3/1976 | Basu et al. | 355/68 |
| 4,113,375 | 9/1978 | Murata et al. | 355/14 E |
| 4,354,758 | 10/1982 | Futaki | 355/14 E |
| 4,378,153 | 3/1983 | Nishimura | 355/3 R |
| 4,390,266 | 6/1983 | Uchida | 355/14 E |
| 4,627,712 | 12/1986 | Vsami | 355/14 R |
| 4,719,489 | 1/1988 | Ohkubo et al. | 355/14 FU X |

FOREIGN PATENT DOCUMENTS

| | | | |
|---|---|---|---|
| 3406568 | 8/1984 | Fed. Rep. of Germany . | |
| 0147659 | 9/1982 | Japan | 355/14 E |
| 0207263 | 12/1982 | Japan | 355/14 R |
| 0137977 | 8/1984 | Japan | 355/14 FU |
| 0194219 | 11/1984 | Japan | 355/14 E |
| 0039667 | 3/1985 | Japan | 355/14 E |
| 0039660 | 3/1985 | Japan | 355/14 E |
| 0039669 | 3/1985 | Japan | 355/14 E |
| 0118861 | 6/1985 | Japan . | |
| 0026070 | 2/1986 | Japan . | |
| 0077988 | 5/1983 | United Kingdom . | |

*Primary Examiner*—Arthur T. Grimley
*Assistant Examiner*—John G. Smith
*Attorney, Agent, or Firm*—Jordan and Hamburg

[57] ABSTRACT

In an automatic exposure device for a copying machine in which the density of an original is detected by irradiating an original by light from a lamp and detecting of the reflecting light with an optical sensor, and in accordance with the detected signal, the exposure amount of the lamp is adjusted by means of an automatic voltage adjusting circuit, and which is equipped with a heater control unit for controlling the energization of a fixing heater for fixing a toner sensible image which has been transferred on paper and a processing circuit for controlling the automatic voltage controlling circuit and heater control section, the processing circuit controlling the heater control section and being operable to maintain the energizing state of the fixing heater in a definite state, while the operation of detecting the original's density occurs with a lamp lit. In this way, fluctuation in the voltage applied to the lamp is prevented from occurring at the time of detecting the density, and the intensity of light from the lamp is thereby kept constant.

8 Claims, 3 Drawing Sheets

AUTOMATIC EXPOSURE DEVICE FOR COPYING MACHINE

BACKGROUND OF THE INVENTION AND RELATED ART STATEMENT

The present invention relates to an automatic exposure device for use in an electrophotographic copying machine, and particularly pertains to an automatic exposure device capable of suppressing fluctuations in the luminous intensity of a lamp for irradiation of an original.

For example, in an electrophotographic copying machine equipped with a prescanning type automatic exposure device, scanning is made before copying by irradiating the original with light from an original irradiation lamp such as halogen lamp, etc., and the original's density is read by receiving the reflected light with an optical sensor. The automatic exposure device has an automatic voltage adjusting circuit for controlling the applied voltage of the original irradiation lamp so as to be constant, which assures that the intensity of light from the original irradiation lamp be kept constant.

However, there is a likehood in such an electrophotographic copying machine that a fixing heater inadvertently comes ON or OFF, while the original irradiation lamp is held in its working state. Since this fixing heater consumes a relatively large amount of electric power, as compared with other units constituting the electophotographic copying machine, it is liable to affect the automatic voltage adjusting circuit for assuring a constant voltage to the original irradiation lamp. For example, during the time that the fixing heater is held on, when the original irradiation lamp comes into its working state, the input voltage to the automatic voltage adjusting circuit falls, for example, from 100V to 92V. In response thereto, the circuit acts so as to keep its output voltage constant to apply a constant voltage to the original irradiation lamp. However, when the performance of the automatic voltage adjusting circuit is not highly accurate, it becomes difficult to keep its output voltage constant against abrupt voltage changes. Consequently, the output voltage goes down and then the applied voltage to the original irradiation lamp drops, resulting in a decrease in the luminous intensity of the original irradiation lamp. Accordingly, the automatic exposure device brings about an error in the read-out of the original's density, and consequently it becomes difficult to provide information for ensuring a proper copied image.

Also, since use of a high performance automatic voltage adjusting circuit raises the cost, it is undesirable to use such a circuit.

SUMMARY OF THE INVENTION

This invention, overcoming the aforementioned technical problem, has as an object to provide an automatic exposure device for a copying machine which assures a proper copied image by reading the original's density at high accuracy without using an expensive automatic voltage adjusting circuit.

An automatic exposure device of the present invention is constructed such that the switching state of a fixing heater is maintained unchanged during the time that an original irradiation lamp is held on to detect the original's density so that a fluctuation in the input voltage of the automatic voltage adjusting circuit is diminished and the output voltage is kept constant. Consequently, the voltage applied to the original irradiation lamp and the intensity of light of the lamp are held constant. Accordingly, the original's density can be detected at a high accuracy with an optical sensor. Thus, it becomes possible to obtain a proper copied image in correspondence to the original's density.

Furthermore, because fluctuation in the input voltage to the automatic voltage adjusting circuit is reduced, it is not necessary to use an expensive high performance automatic voltage adjusting circuit. Accordingly, a constant output voltage can be obtained with an inexpensive automatic voltage adjusting circuit and thus attain a reduced cost.

DETAILED DESCRIPTION OF PREFERRED EMBODIMENTS OF THE INVENTION

An embodiment of the present invention will be described below with reference to the accompanying drawings.

Figure 2:
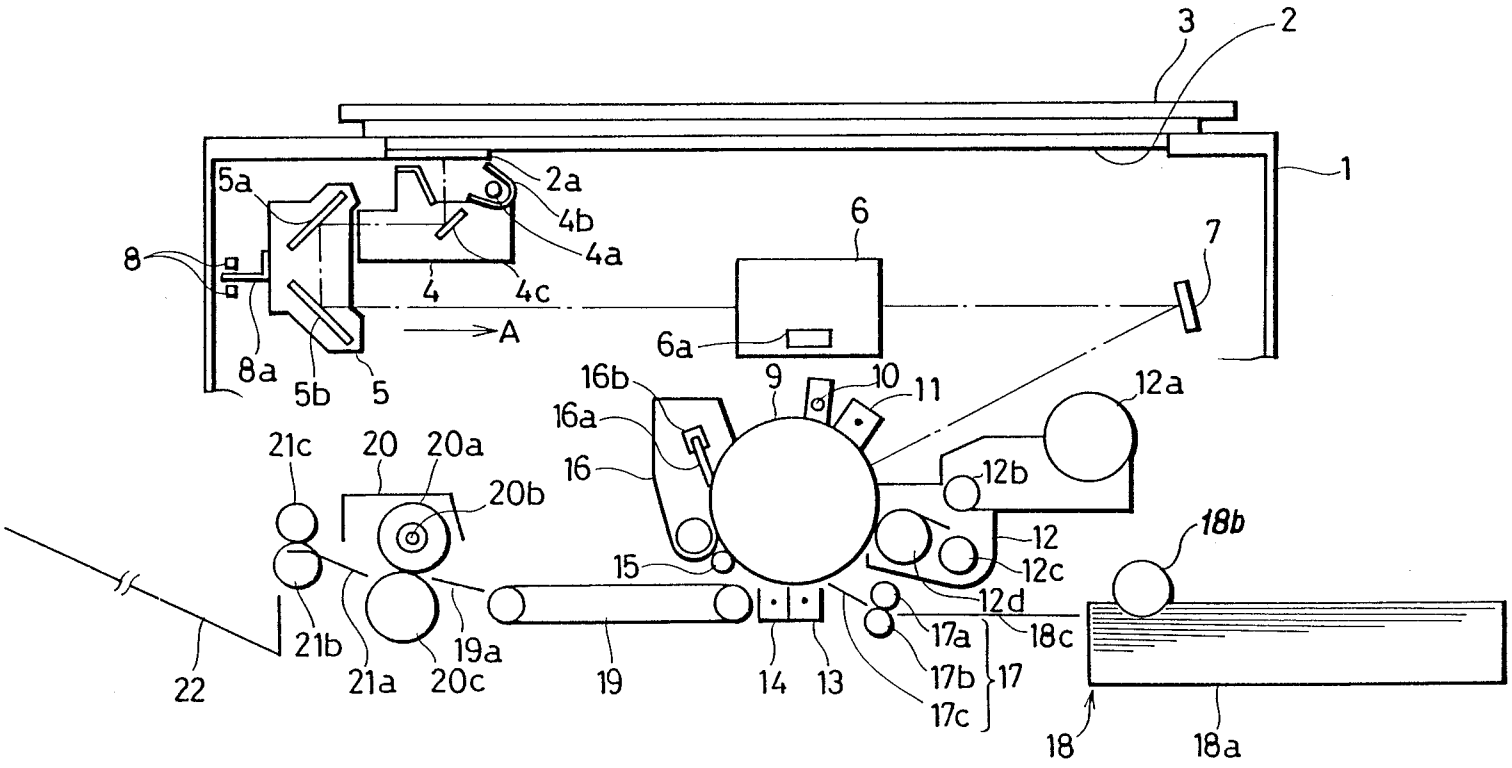
FIG. 2 is a whole composition diagram of the electrophotographic copying machine equipped with the aforementioned automatic exposure device.

FIG. 2 is a whole composition diagram of an electrographic copying machine equipped with an automatic exposure device of the present invention. In FIG. 2, the electrographic copying machine of the embodiment has a housing 1, contact glass 2 on which an original in put and an original cover 3, etc. On the underside of one end of the contact glass 2 there is provided a white paper 2*a*. An optical system includes an original irradiation lamp 4*a*, such as a halogen lamp, a first traveller 4 equipped with a reflection plate 4*b* and a mirror 4*c*, a second traveller 5 equipped with mirrors 5*a* and 5*b*, a lens assembly 6 equipped with an optical sensor 6*a* for detecting the original's density and a mirror 7. On the outside of the second traveller 5 is mounted a light-shielding plate 8*a* for switching the optical sensor 8 to detect whether or not the second traveller 5 is at a home position as shown in FIG. 2.

Around a photoreceptor drum 9 which receives reflecting light from the mirror 7 are arranged in the order of a turning direction a pre-exposure lamp 10, a main charger unit 11 including a corona-discharger, a developing unit 12, a transferring unit 13, a separating unit 14, a charge removing lamp 15, a cleaning unit 16, etc. The photoreceptor drum 9 has an exposure region corresponding to the optical system between the main charger unit 11 and the developing unit 12.

The developing unit 12 having a toner hopper 12*a*, a toner supply roller 12*b*, a toner stirring roller 12*c* and a developing roller 12*d* feeds a developer, for example, developing toner onto the photoreceptor drum 9, so that static latent image formed by the exposure system is developed as a toner image. In the downstream side of the developing unit 12 in the turning direction of the drum 9 and in the upstream side of the transferring unit 13 and near the photoreceptor drum 9 there is provided a conveying unit 17 including rotationally driven conveying rollers 17*a* and 17*b* for conveying copying paper to the transferring unit 13 and a guide plate 17*c* for guiding the copying paper fed from the conveying rollers 17*a* and 17*b* to the transferring unit 13.

The cleaning unit 16 has a cleaning blade 16*a* and a blade solenoid 16*b* for causing the cleaning blade 16*a* to come into contact with and move away from the surface of the photoreceptor drum 9. The paper feeding unit 18 includes a copying paper cassette 18*a* in which copying paper is held, a feed paper roller 18*b* for feeding out the copying paper and a guide plate 18*c* for guiding the copying paper fed out by the feed paper roller 18*b* to the conveying unit 17. In the downstream side of the feeding direction of the separating unit 14 there is provided a conveying belt assembly 19.

In the downstream side of the conveying belt assembly 19 there is provided a fixing unit 20. A guide plate 19*a* is provided between them. The fixing unit 20 includes a fixing heat roller 20*a* having a fixing heater 20*b* in the center of the roller 20*a* and a fixing roller 20*c* forming a pair by combination with the roller 20*a*. In the downstream side of the fixing unit 20 are provided a guide plate 21*a* for guiding copy paper coming from the fixing device 20, discharge rollers 21*b* and 21*c* for discharging copying paper coming from the guiding plate 21*a* and a tray 22 for receiving copying paper discharged from the discharge rollers 21*b* and 21*c*.

Figure 1:
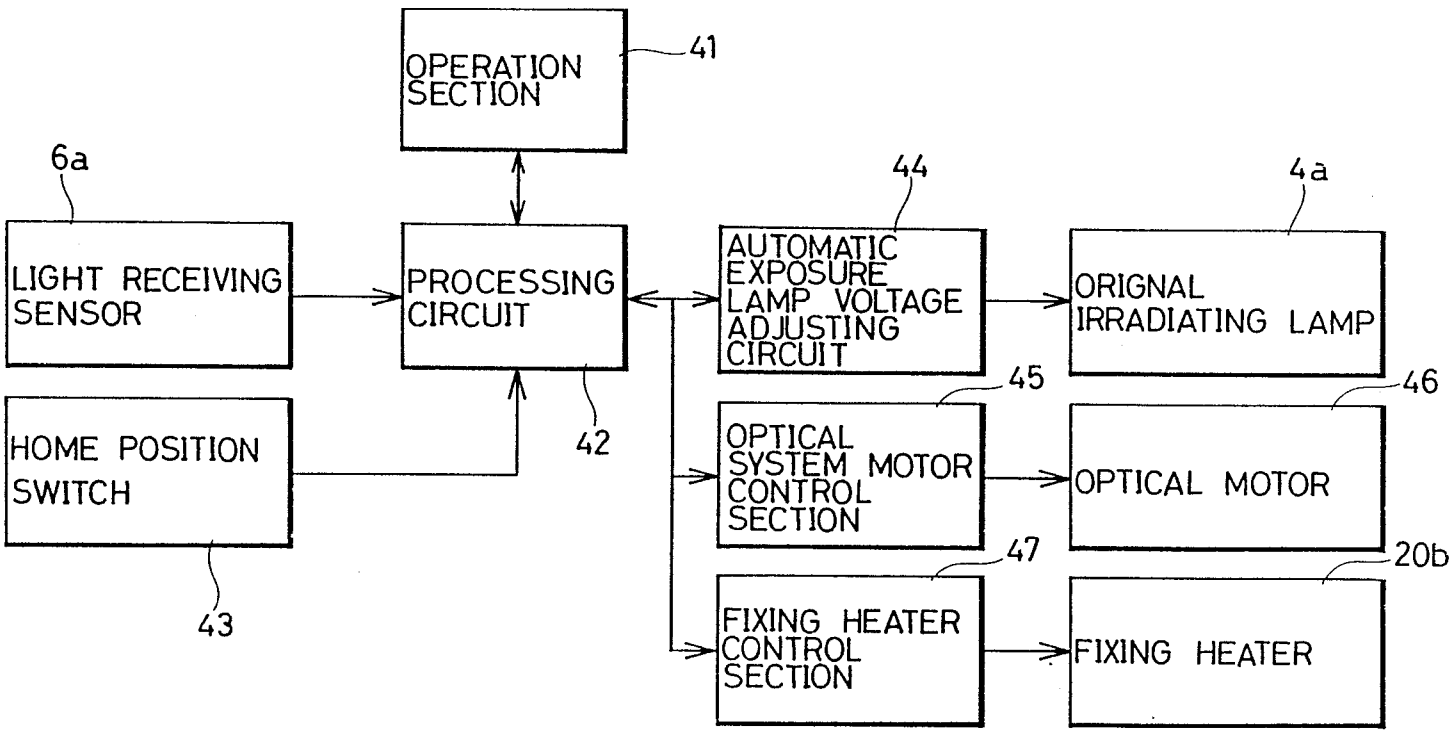
FIG. 1 is a block diagram showing an automatic exposure device for electrophotographic copying machine of the present invention.

FIG. 1 is a block diagram showing the automatic exposure device of the invention. In FIG. 1, an operation section 41 includes a print key switch which is operated at the time of copying, a switch for setting an automatic exposure mode and a plurality of key switches for inputting information necessary for copying, etc. A processing circuit 42 made up of a microcomputer, etc. receives outputs from the operation section 41, light receiving sensor 6*a* and a home position switch 43, i.e., the optical sensor 8 shown in FIG. 2, and executes later described processing so as to control the exposure lamp automatic voltage adjusting circuit 44 for operating the original irradiation lamp 4*a*, an optical motor control section 45 for controlling a motor 46 of the optical system for driving the first and the second travellers 4 and 5, and a fixing heater control section 47 for operating the fixing heater 20*b*.

Figure 3:
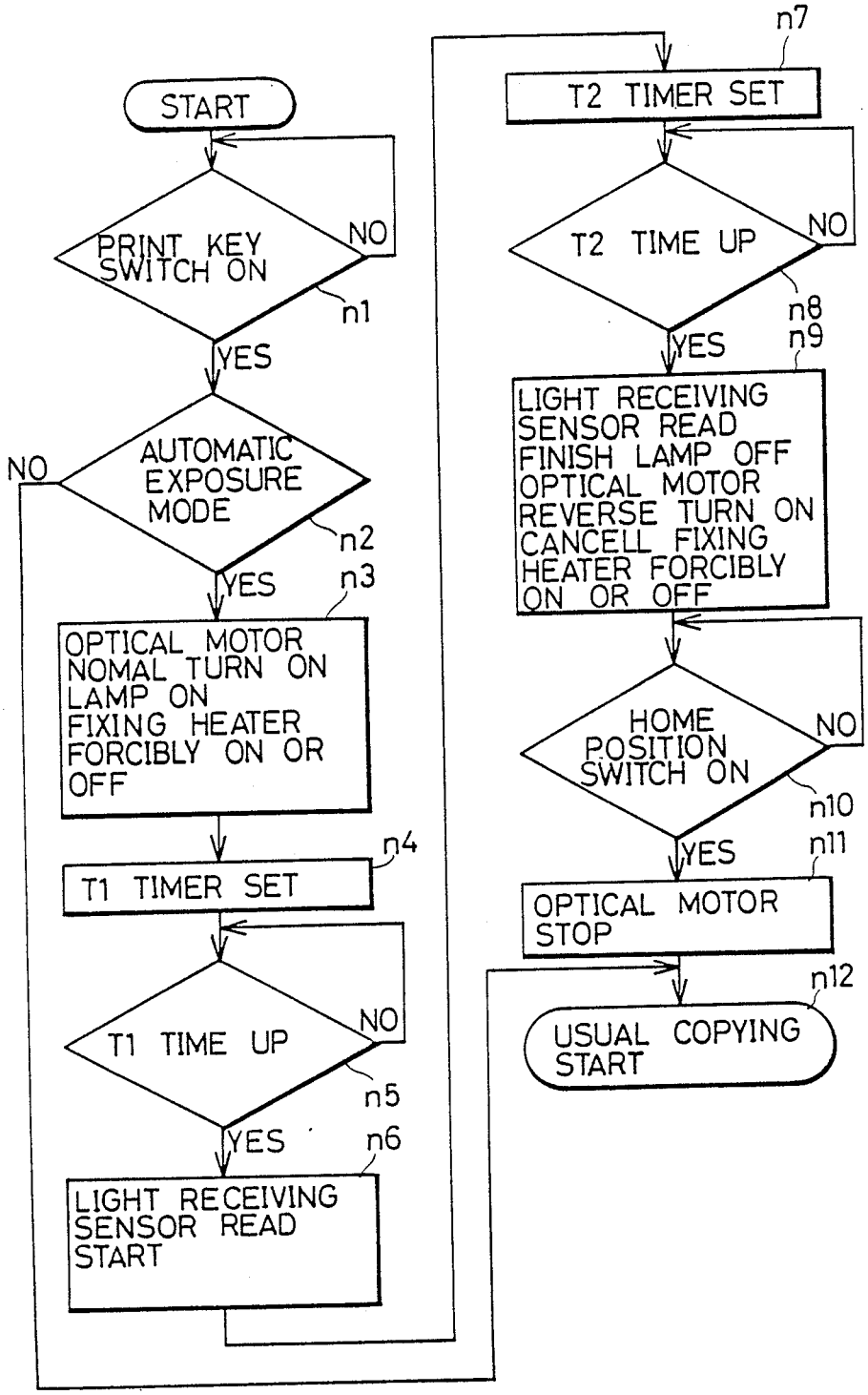
FIG. 3 is a flow-chart showing the operation of the aforementioned automatic exposure device.

The operation of the embodiment will be described below with reference to the flow chart shown in FIG. 3.

At step n1, it is executed to determine whether the print key switch of the operation section 41 is turned on. When it is turned on, the operation advances to n2 at which it is executed to determine whether an automatic exposure mode setting switch of the operation section 41 is turned on and whether the automatic exposure mode is set. When the automatic exposure mode is set, the operation advances to n3 at which the processing circuit 42 receives outputs from the home position switch 43 and determined whether or not the first and the second travellers 4 and 5 are set at their home positions as shown in FIG. 3. When the outputs indicate that they are set at their home positions, the optical motor control section 45 is operated so as to cause the optical motor 46 to rotate in the normal direction. The normal rotation of the optical motor 46 makes the first and the second travellers 4 and 5 move in the direction of arrow A (FIG. 2). In other words, the prescanning operation is carried out to detect the original's density before the optical system starts the usual copying operation. The processing circuit 42 controls the exposure lamp automatic voltage adjusting circuit 44 so as to raise the intensity of light from the original irradiation lamp 4*a* higher than that at the usual copying time to keep the intensity of light constant. Moreover, the circuit 42 brings the fixing heater 20*b* to forcibly maintain an ON or OFF state through the fixing heater control section 47 during the time that the pre-scanning is executed and the original irradiation lamp 4*a* is held in its working state. More specifically, the fixing heater 20*b* is usually turned on or off by the fixing heater control section 47 in accordance with a signal from a sensor for detecting the temperature of the fixing heat roller 20a so that the heater is maintained at a predetermined temperature. On the other hand, during the prescanning operation, the fixing heater 20*b* is held in a switching state (ON or OFF) at the point of time when the original irradiation lamp 4*a* is put into working operation, irrespective of the temperature of the fixing heat roller 20*a*.

At step n4, a timer is set which is provided in the processing circuit 42 and serves to count a first specified time T1 including the lead time which is the period of time betw3en the time that the original irradiation lamp 4a is turned on the time that a rated intensity of light is attained and the moving time during which the original irradiation lamp 4a reaches the original position of the original from the home position. At step n5, it is determined whether the timer reaches the first specified time T1. When the time elapses, the operation advances to n6. At step n6, after the lapse of the first specified time T1, the light receiving sensor 6*a* detects the reflecting light from the original and the processing circuit 42 starts the reading of output from the light receiving sensor 6*a*.

At step n7, the timer in the processing circuit 42 is set to count a second specified time T2 which is the moving time of the optical system for determining the reading region of the original in a copy scanning region where the irradiation light from the original irradiation lamp 4a scans the original. At step n8, it is determined whether the timer reaches the second specified time T2 and when the second specified time T2 elapses, the operation enters n9, in which the first and the second travellers 4 and 5 scan the whole copy scanning region. The processing circuit 42 receives the output from the light receiving sensor 6*a* and completes the reading process of the original's density. Then the original irradiation lamp 4*a* is turned off, and the optical motor 46 is actuated in the reverse direction and the forcibly set on or off state of the fixing heater 20*b* is cancelled. At step n10, it is determined whether the first and the second travellers have 4 and 5 returned to their home positions by detecting whether the home position switch 43 is turned on. When the travellers return to their home positions, the operation enters step n11 at which time the optical motor 46 is stopped.

Thereafter, the operation advances to step n12, at which the usual copying operation is started. The density of the copy image produced at this step corresponds to that of the original.

At step n2, when the mode switch is not turned on and an automatic exposure mode is not set, the operation enters step n12 at which the copying operation is started at a density set by the operator irrespective of the original's density.

The embodiment in which switching state of the fixing heater 20*b* is held unchangeable when the original irradiation lamp 4*a* is in a working state to detect the original's density eliminates the fluctuation of input voltage of the automatic exposure lamp voltage adjustment circuit 44. Accordingly, the output voltage or the voltage applied to the original irradiation lamp 4*a* is kept constant. Consequently, the intensity of light from the original irradiation lamp 4a will not fluctuate and the original's density can be detected by the light receiving sensor 6a at a high accuracy. Thus a proper copy image corresponding to the original's copy density is obtainable.

Though an embodiment has been described which is such that the on or off switching state of the fixing heater 20b is forcibly maintained when the original irradiation lamp 4a is in a working state, it will be needless to say that a device of the present invention may be constructed such that when the switching state of the fixing heater 20b is on, which is detected when the print key switch of the operation section 41 is turned on, the on-state is maintained. On the other hand, when the state is off, off-state is maintained. Furthermore, irrespective of the switching state of the fixing heater 20b when the print key switch is on, the fixing heater 20b may be forcibly set either in its on-state or off-state. The switching state of the fixing heater 20b set in this way is maintained until the read-out process by the light receiving sensor 6a completes at step n9 shown in FIG. 3. In such control, since the switching state of the fixing heater 20b is not changed while the original irradiation lamp 4a is in a working state during the prescanning time, the same effect as that of the aforementioned embodiment is achieved.

Though the above embodiment has been described with reference to a copying machine in which an original is scanned by a travelling optical system, it will be noted that the present invention is applicable to a copying machine in which while an optical system is not moved but an original is moved, because it is sufficient to move the optical system and original in relation to each other.

What is claimed is:

1. In an automatic exposure device for a copying machine comprising an optical system which executes a prescanning operation while irradiating light from a lamp onto an original, an optical sensor for detecting the density of the original by receiving reflecting light from said original, an automatic voltage adjusting circuit for adjusting the exposure amount of said lamp in accordance with a signal corresponding to the density detected by said optical sensor, a photoreceptor on which a static latent image is formed by exposure scanning of the original by said optical system, a developing unit for developing the static latent image on said photoreceptor to a toner sensible image, a transfer unit for transferring said toner sensible image to paper, a fixing unit including a fixing heat roller and a fixing heater for fixing the toner sensible image transferred on said paper, a heater control means including a temperature sensor for detecting the temperature of said fixing heat roller for controlling energization of said fixing heater between two switching states. including an on-state and an off-state in response to the temperature detected by said temperature sensor, and a processing circuit control means for controlling said automatic voltage adjusting circuit and said heater control means and operable to maintain said heater control means in a predetermined on of said two switching states during said prescanning operation, said processing circuit control means being operable, when said optical system is about to initiate execution of said prescanning operation and said heater control means is not in said predetermined switching state, to forcibly switch said heater control means to said predetermined switching state and maintain said predetermined switching state during said prescanning operation irrespective of the temperature of said fixing heat roller

2. In an automatic exposure device according to claim 1 wherein said processing circuit control means is operable, when said optical system is about to initiate execution of said prescanning operation and said heater control means is in said predetermined switching state, to maintain said predetermined switching state during said prescanning operation.

3. In an automatic exposure device according to claim 1, wherein said optical system shuts off said lamp upon completion of said prescanning operation.

4. In an automatic exposure device according to claim 1, wherein said optical system irradiates light from said lamp onto said original during said exposure scanning, said processing circuit control means being operable to control said automatic voltage adjusting circuit to raise the intensity of the light from said lamp during said prescanning operation relative to the intensity of the light from said lamp during said exposure scanning.

5. In an automatic exposure device according to claim 3, wherein said processing circuit control means is operable to disable maintenance of said fixing heater in either of said switching states upon completion of said prescanning operation.

6. In an automatic exposure device for a copying machine in which a copy is made from an original, the combination comprising an optical system which executes a prescanning operation while irradiating light from a lamp onto said original, an optical sensor for detecting the density of said original by receiving reflected light from said original, an automatic voltage adjusting circuit means for adjusting the amount of exposure of said lamp in accordance with a signal corresponding to the density detected by said optical sensor, imaging means for producing an image from said original and for transferring a corresponding toner image to said copy, a fixing means comprising a fixing heater and a fixing heat roller for fixing said tone image onto said copy, said fixing means further comprising a fixing heater control means which includes a temperature sensor for detecting the temperature of said fixing heat roller and operable for energizing said fixing heater between two switching states including an on-state and an off-state in response to the temperature detected by said temperature sensor and a processing circuit control means for controlling said automatic voltage adjusting circuit means and said fixing heater control means and operable to maintain said heater control means in a predetermined one of said two switching states during said prescanning operation, said processing circuit control means being operable, when said optical system is about to initiate execution of said prescanning operation and said heater control means is not in said predetermined switching state, to forcibly switch said heater control means to said predetermined switching state and maintain said predetermined switching state during said prescanning operation irrespective of the temperature of said fixing heat roller.

7. In an automatic exposure device according to claim 6 wherein said processing circuit control means is operable when said optical system is about to initiate execution of said prescanning operation and said heater control means is in said predetermined switching state, to maintain said predetermined switching state during said prescanning operation.

8. In an automatic exposure device according to claim 6, wherein said optical system initially moves from a home position when said prescanning operation is initiated, said processing circuit control means comprising a timer for determining a period of time between the time that said lamp is first turned on and the time that a rated intensity of light is attained plus the time it takes said optical system to move from said home position to encounter said original, said processing circuit control means initiating operation of said optical sensor subsequent to expiration of said first period of time.

* * * * *

UNITED STATES PATENT OFFICE

CERTIFICATE OF CORRECTION

Patent No. 4,819,022 Dated April 4, 1989

Inventor(s) Shigeo KURANDO

It is certified that error appears in the above-identified patent and that said Letters Patent is hereby corrected as shown below:

Claim 1, column 5, line 62, change "on" to --one--.

Claim 8, column 8, last line, delete "first".

Signed and Sealed this

Sixteenth Day of January, 1990

*Attest:*

JEFFREY M. SAMUELS

*Attesting Officer* *Acting Commissioner of Patents and Trademarks*